United States Patent [19]

Reznick

[11] 4,448,475

[45] May 15, 1984

[54] METHOD AND APPARATUS FOR TREATMENT OF TINNED METAL SURFACES AND TREATED TINNED METAL SURFACE

[76] Inventor: David Reznick, 21 Rehov Raanan, Haifa, Israel

[21] Appl. No.: 339,150

[22] Filed: Jan. 13, 1982

[30] Foreign Application Priority Data

Jul. 7, 1981 [IL] Israel ..... 63243

[51] Int. Cl.[3] ..... C25F 1/00

[52] U.S. Cl. ..... 204/140

[58] Field of Search ..... 204/140, 56 R

[56] References Cited

U.S. PATENT DOCUMENTS

| | | | |
|---|---|---|---|
| 2,215,165 | 9/1940 | Sumner | 204/32 R |
| 2,687,994 | 8/1954 | Russell et al. | 204/37 |
| 2,773,817 | 12/1956 | Russell et al. | 204/37 |
| 2,812,296 | 11/1957 | Neish | 204/28 |
| 2,906,677 | 9/1959 | Smith | 204/56 R |
| 3,313,714 | 4/1967 | Joyce | 204/140 |
| 3,791,940 | 2/1974 | Alexander | 204/35 N |
| 3,901,771 | 8/1975 | Froman et al. | 204/28 |
| 3,959,091 | 5/1976 | Moji et al. | 204/38 A |
| 4,026,777 | 5/1977 | Zaremski et al. | 204/141.5 |
| 4,066,521 | 2/1978 | Zaremski et al. | 204/141.5 |
| 4,180,417 | 12/1979 | Oka et al. | 148/6.15 Z |
| 4,210,506 | 7/1980 | Hoppe et al. | 204/181 C |
| 4,264,418 | 4/1981 | Wood et al. | 204/129.95 |
| 4,273,625 | 6/1981 | Van de Leest | 204/56 R |

OTHER PUBLICATIONS

*Chemical Abstracts* 93:227573H.

*Chemical Abstracts* 92:118521y.

*Primary Examiner*—T. M. Tufariello

*Attorney, Agent, or Firm*—Browdy & Neimark

[57] ABSTRACT

A method for anodically treating a tinned metal surface prior to coating with an organic coating including the steps of placing the surface in an electrolyte bath, maintaining the surface at a relatively positive voltage and maintaining the electrolyte at a relatively negative voltage. An article treated according to the method is also disclosed.

12 Claims, 1 Drawing Figure

METHOD AND APPARATUS FOR TREATMENT OF TINNED METAL SURFACES AND TREATED TINNED METAL SURFACE

FIELD OF THE INVENTION

The present invention relates to the interrelationship of tinned metal surfaces and organic coatings generally and more particularly to the treatment of tinned metal surfaces with a view towards improving the long term adhesion of the organic coatings to the tinned metal surfaces.

The discussion which follows deals in particular with the coating of tinplate with lacquer for protection against underfilm corrosion and blistering, a technique which is of central importance to the canning industry. It is to be understood that reference here to lacquer coating of tinplate is merely exemplary and for the purposes of illustration and that the teachings of the invention are applicable to a wide range of situations in which a tinned metal surface is coated with an organic coating.

BACKGROUND OF THE INVENTION

Most of the tin plate used for can manufacture is electrolytic plated. It is generally appreciated by persons skilled in the art that tin plate surfaces are usually treated by what is commonly termed "passivation".

One type of passivation, known as 300 involves dipping the tinplate in hot chromic acid and chromic salts, producing chromium oxide and tin oxide on the tin plate surface. A second type of passivation, known as 311, involves cathodic treatment of the tinplate in a dichromate solution maintained at a positive potential. The tin plate which is maintained at a negative potential receives a coating of metallic chromium, chromium oxide and tin oxide.

A variation of the 311 passivation treatment, known as 314, requires a dichromate bath maintained at an elevated temperature and a higher current than the 311 treatment and produces relatively more metallic chromium. A further passivation treatment, known as 320, involves anodic treatment in dichromate and has been found to be unsatisfactory from a lacquer adhesion standpoint.

All of the known passivation treatments, of which 311 is the most popular, do not produce predictable or uniform results. Thus two different batches of tinplate, both of which having undergone 311 passivation may exhibit drastically different lacquer adhesion qualities. Tin plate treated by the 320 passivation treatment normally exhibits the least satisfactory lacquer adhesion qualities.

SUMMARY OF THE INVENTION

There is provided in accordance with an embodiment of the invention a method of anodically treating a tinned metal surface prior to coating with an organic coating so as to increase the long-term adhesion of the organic coating to the tinned metal surface and comprising the step of:

placing said tinned metal surface in an electrolyte bath wherein said electrolyte comprises one or more of the following substances: tap water, dilute nitrate salts, dilute hydrochloric acid, dilute nitrite salts, dilute sulfuric acid, dilute nitric acid.

Particularly favorable results are obtained with an electrolyte containing zinc nitrate or aluminum nitrate.

Particularly favorable results are obtained when the tinned metal surface is maintained at a relatively positive voltage and the electrolyte is maintained at a relatively negative voltage.

BRIEF DESCRIPTION OF THE DRAWINGS

The invention will be more fully understood and appreciated from the following detailed description taken in conjunction with the drawing in which.

DETAILED DESCRIPTION OF THE INVENTION

Figure 1:
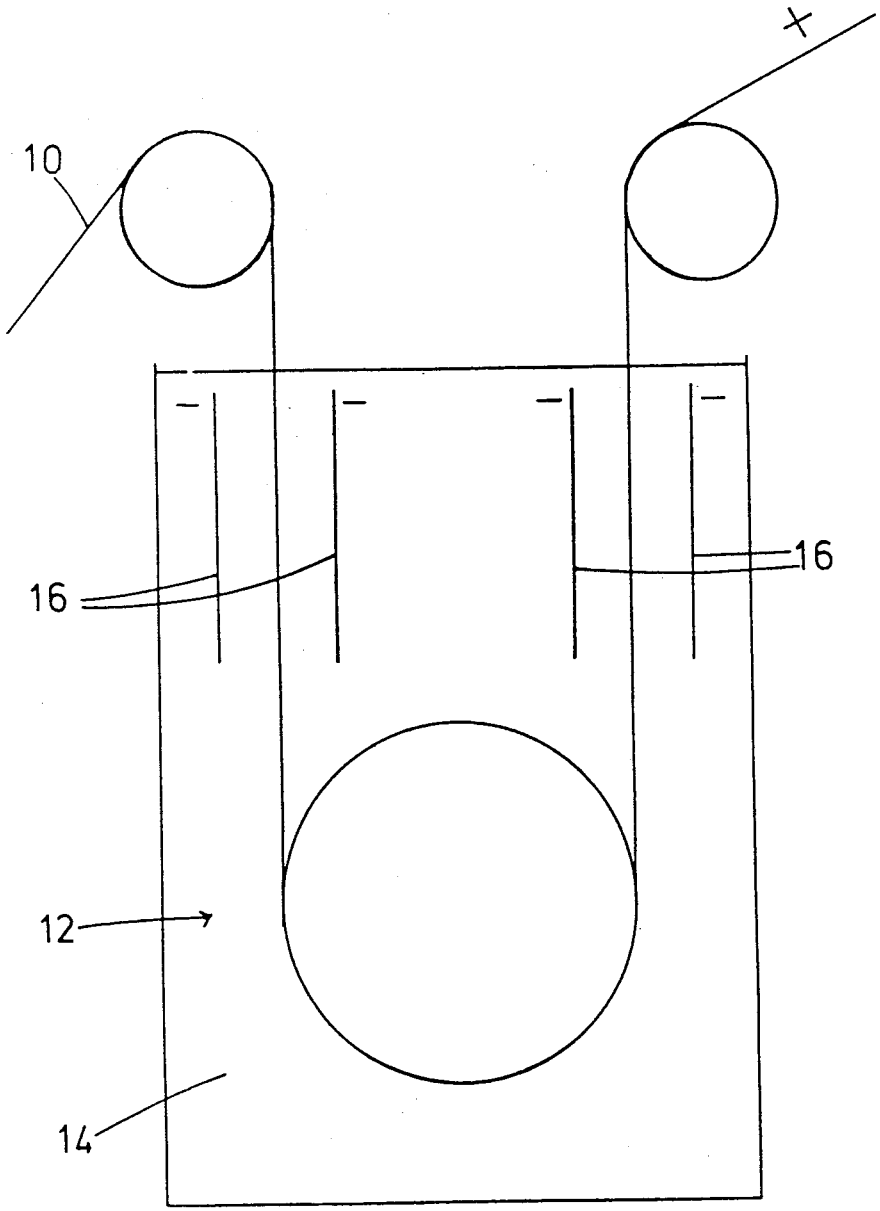
FIG. 1 illustrates apparatus for treating tinned metal surfaces in accordance with an embodiment of the invention.

Conventionally the quality of a coated tin plate surface is tested by first scratching the surface and then attempting to remove the coating with adhesive tape. This mechanical test of dry adhesion, however, is not determinative of the quality of the coating under actual conditions. Conventional sterilization tests are also not determinative of the quality of the coating under actual conditions.

In accordance with the present invention, it is appreciated that the performance of coated tin plate under dry adhesion or sterilization tests does not guarantee that wet adhesion of the lacquer coating will be satisfactory. The wet adhesion of the coating to the tin plate is determined by the quality of the tin plate surface, the nature of the coating, the conditions of its application, and the nature of the canned substance. Detachment of the coating from the tinplate is produced by the interaction of the canned substance and the coated tinplate.

Thus it may be understood that if two identical cans are filled with different substances, say tomatoes and peas, drastically different results will be produced. Similarly if the same substance is placed in two different cans having the same lacquer and different tinplate the results can be drastically different.

The effect of the substances on the coated tinplate over time may result in blistering with or without significant corrosion of the tinplate or in underfilm corrosion of the tinplate and resulting detachment of the lacquer.

Underfilm corrosion of a tinned metal surface may occur independently or together with blistering and peeling. Underfilm corrosion or blistering occurs where the tinned metal surface is scratched or scraped or stressed and results in the separation of the lacquer from the tinned metal surface. In the manufacture of cans from lacquer coated metal, such stresses often occur, particularly when a can is formed with corrugations. It is appreciated that various food substances have differing degrees of underfilm corrosion effects on tinned metal surfaces.

The qualities of adhesion of an organic coating such as a lacquer onto a tinned metal surface are mainly dependent on the tinned metal surface. Lacquer which does not, for example, adhere to a given tinned metal surface may strongly adhere to the surface after cleaning and proper surface treatment in accordance with the present invention.

In accordance with the present invention there is provided a technique for improving the adhesion and the resistance to underfilm corrosion of an organic coating, such as lacquer to a metal surface such as tin plate.

Reference is now made to FIG. 1 which shows sheet metal, such as tin plate 10 disposed in a bath 12 containing a treatment solution 14. The sheet metal is coupled to a source of relative positive voltage and an electrode 16, typically formed of stainless steel, steel or tin and of the same width as the sheet metal is disposed in the treatment solution facing the surface of the sheet metal to be treated. Where both surfaces of the sheet metal are to be treated, two electrodes 16 are employed, one facing each surface of the sheet metal. Electrode 16 is coupled to a source of relative negative voltage.

In experiments carried out by the applicant, good results were obtained using a 0.2% ammonium nitrate salt and 0.1% nitric acid solution as the treatment solution 14 and a current of between 3 and 5 amperes per square decimeter of metal surface to be treated. The treatment time, which depends on the current, may be in the range of between a fraction of a second to a few seconds. It was found that raising the solution temperature above room temperature may improve the treatment and shorten the required time for treatment.

It is noted that various alternative treatment solutions may be employed and may include ordinary tap water, nitrate salts such as those of ammonium, sodium zinc and aluminum. Acidification of the treatment solution to a pH of approximately 2.5 is desirable in order to prevent the solution from turning white during treatment. Such acidification is not, however, always required.

It is also noted that the specific chromate solutions employed in the industrial cathodic passivation technique 311 and the anodic passivation technique 320 produce singularly undesirable results when employed as the treatment solution in the anodic treatment described hereinabove in accordance with the teachings of the present invention.

It is a particular feature of the invention and a particular advantage of the technique described above in connection with FIG. 1 that adhesion and resistance to underfilm corrosion of thick-layer (5–10 microns) and overbaked lacquer coatings to a tinned metal surface treated in accordance with the teachings of the invention remains strong.

It is well known that with prior-art passivation and metal coating techniques there exists a trade-off between lacquer resistance to ion diffusion thereacross and lacquer resistance to underfilm corrosion. More specifically, thick lacquer layers which provided good resistance to ion diffusion had poor adhesion characteristics. Furthermore, in the prior art, great care had to be taken to insure that the lacquer layer did not become overbaked, since overbaking greatly decreased the adhesion of the lacquer to the tinned metal surface.

In accordance with the present invention lacquer applied to a treated surface retains good adhesion to the tinned metal surface notwithstanding overbaking and being applied as a thick layer.

It is also appreciated that the treatment technique of the present invention can be applied to sheets as well as to strips of metal or to any suitable tinned metal surface in any form such as a manufactured can.

It is noted that removal of surface oil from tinplate sheets prior to treatment may provide improved and uniform results. Such removal may not, however, be necessary.

A major advantage of the tinned metal surface treatment technique provided in accordance with the present invention is the high resistance to lacquer peeling due to scratches, stretches and sheared surfaces, all of which are difficult to prevent in conventional can manufacture. Use of treated metal surfaces in accordance with the present invention enables tin plate to be coated with a selected lacquer which is suitable for canning of an extremely wide range of products having extremely varied characteristics and despite relatively thick application and overbaking of the applied lacquer to provide good adhesion and resistance to blistering and underfilm corrosion.

The treatment according to the present invention may be applied after any other suitable conventional metal surface treatment. It does not detract from the effectiveness of previous treatments such as chromium or chromium oxide deposition against sulphur staining.

It is also noted, that in accordance with an alternative embodiment of the invention, satisfactory results may be obtained even when electrode 16 is not coupled to a source of negative voltage and/or when the sheet metal is not coupled to a source of positive voltage. It has been found in such a case that even though both the sheet metal being treated and the solution are left "free floating", nevertheless a small but not negligible electric current is produced thereacross. This current may result for example from grounding of the solution via its container. The application of an applied voltage across the sheet metal and the solution as indicated hereinabove is, however, recommended for better, controlled, uniform and reproducible results.

The tinned metal surfaces may be treated on one or both sides when in sheet form, and may alternatively be in web form or define the walls of a solid or empty body. Various types of treatment substances and solutions may be used. The exact type of treatment used is determined in each case on the basis of testing and evaluation. It will be understood by persons skilled in the art that the present invention is not limited by what has been specifically shown and described hereinabove. Rather the scope of the present invention is defined only by the claims which follow:

I claim:

1. A method of anodically treating a tinned metal surface prior to coating with an organic coating so as to increase the long-term adhesion of the organic coating to the surface comprising the steps of:

placing said surface in an electrolyte bath wherein said electrolyte comprises one or more of the following substances:

tap water, dilute nitrate salts of concentration approximately 0.2%, dilute hydrochloric acid, dilute nitrite salts, dilute sulfuric acid, dilute nitric acid of concentration approximately 0.1%, wherein the electrolyte has a pH of approximately 2.5, maintaining said tinned metal surface at a relatively positive voltage, maintaining said electrolyte at a relatively negative voltage, and passing a current of between 3 and 5 amperes per square decimeter of metal surface to be treated through said surface for up to a few seconds, and wherein cathodic treatment of the surface does not follow the foregoing steps.

2. A method according to claim 1 and wherein said electrolyte comprises zinc nitrate.

3. A method according to claim 1 and wherein said electrolyte comprises aluminum nitrate.

4. A method according to claim 1 and also comprising the step of providing a current across said electrolyte and said tinned metal surface.

5. A method according to claim 1 and wherein a negative electrode is immersed in said electrolyte and coupled to a source of relative negative voltage.

6. A method according to claim 1 and wherein said tinned metal surface comprises a plurality of metal sheets.

7. A method according to claim 1 and wherein the tinned metal surface is in the form of a manufactured can.

8. A tinned metal surface treated in accordance with the method of claim 1.

9. A can formed of tin plate which has been treated in accordance with the method of claim 1.

10. A method of anodically treating a tinned metal surface prior to coating with an organic coating so as to increase the long-term adhesion of the organic coating to the surface comprising the steps of:

placing said surface in an electrolyte bath wherein said electrolyte comprises an aluminum nitrate salt;

maintaining said tinned metal surface at a relatively positive voltage and maintaining said electrolyte at a relatively negative voltage and passing a current of between 3 and 5 amperes per square decimeter of metal surface to be treated for a treatment time of between a fraction of a second to a few seconds, and wherein the aforesaid steps are not followed by cathodic treatment of said surface.

11. A tinned metal surface treated in accordance with the method of claim 10.

12. A can formed of tin plate which has been treated in accordance with the method of claim 10.

* * * * *